United States Patent [19]

Fieuzal et al.

[11] 3,976,266

[45] Aug. 24, 1976

[54] MISSILE WITH CRUCIFORM GUIDANCE SYSTEM

[75] Inventors: Jean Henri Fieuzal, Rueil Malmaison; Louis Gaston Bourgine, Chambourcy; André Camille Jean, Conflans Sainte Honorine; René Pierre Benzoni, Paris, all of France

[73] Assignee: Etat Francais, France

[22] Filed: Mar. 29, 1974

[21] Appl. No.: 456,266

[30] Foreign Application Priority Data

Apr. 17, 1973 France ..... 73-13815

[52] U.S. Cl. ..... 244/3.21

[51] Int. Cl.[2] ..... F42B 15/16

[58] Field of Search ..... 244/3.21; 102/3

[56] References Cited

UNITED STATES PATENTS

| | | | |
|---|---|---|---|
| 3,104,081 | 9/1963 | Arnett | 244/3.21 |
| 3,128,061 | 4/1964 | Chew | 102/3 X |
| 3,154,015 | 10/1964 | Muller | 244/3.21 |
| 3,373,955 | 3/1968 | Huska | 244/3.21 |

*Primary Examiner*—Verlin R. Pendegrass

*Attorney, Agent, or Firm*—Larson, Taylor and Hinds

[57] ABSTRACT

A missile provided with a cruciform guidance system comprising a pair of north-south and a pair of east-west fins, each pair being coupled with a respective annular support pivotally mounted externally of the body of the missile. A pair of diammetrically opposed control devices is provided to control the pivotal adjustment of each annular support thereby to control the angle presented by the plane containing the north-south or east-west fins relative to the longitudinal axis of the missile body.

If desired, each fin may be pivotally mounted on its respective support for movement between a folded position and an open position to facilitate launching of the missile from a launching tube.

13 Claims, 6 Drawing Figures

-FIG. 1-
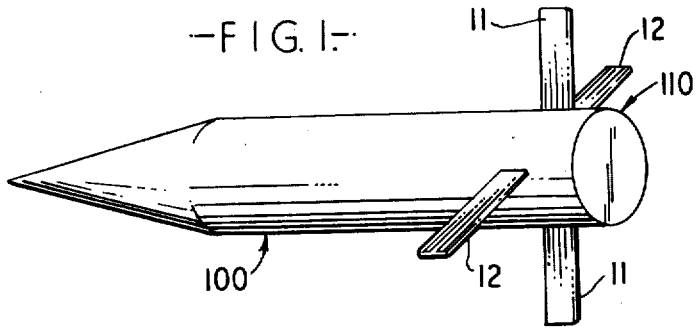
-FIG. 2-
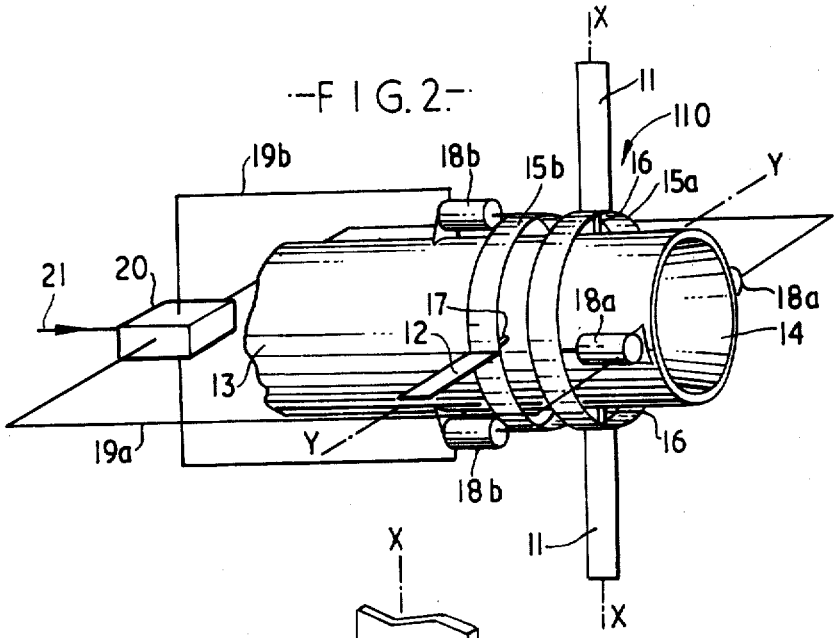
-FIG. 3-
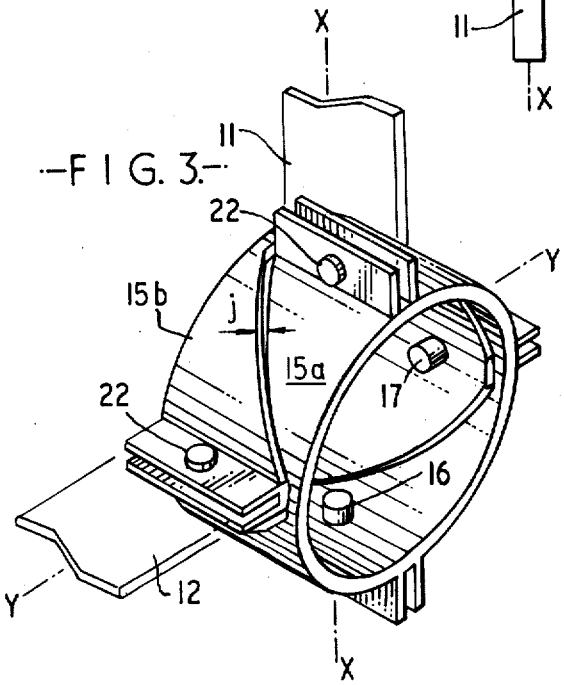

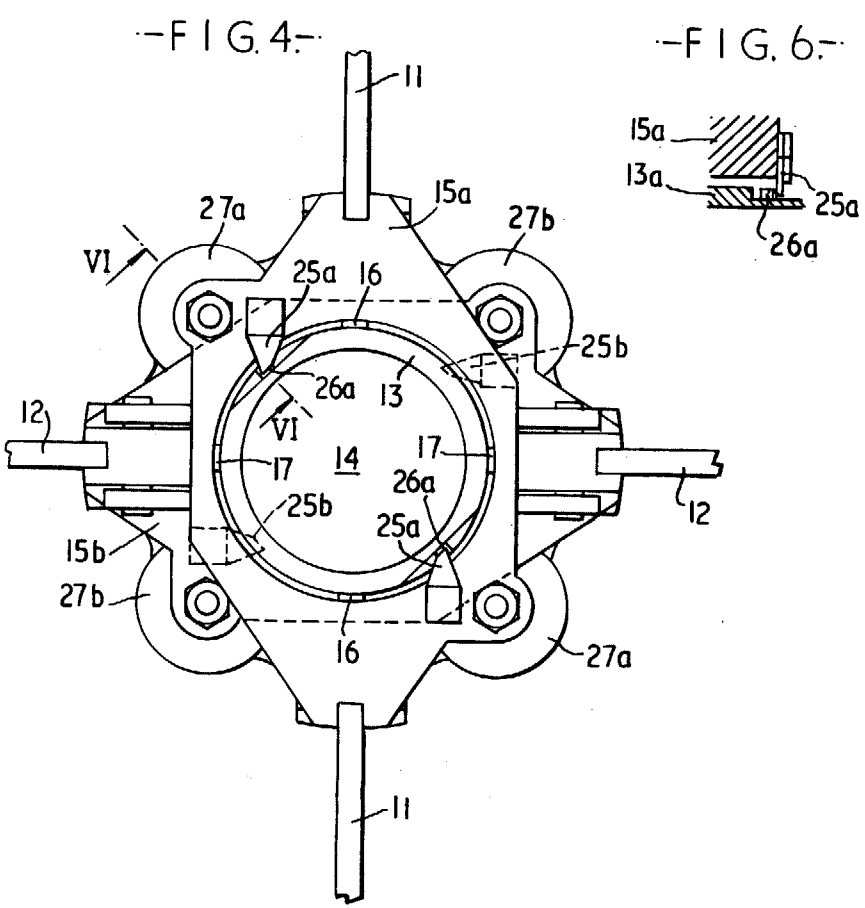
-FIG. 4.-
-FIG. 6.-
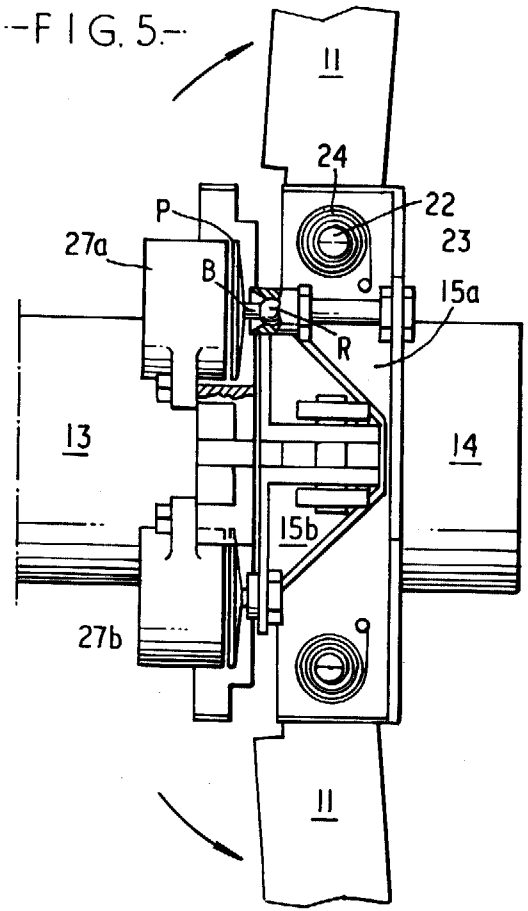
-FIG. 5.-

MISSILE WITH CRUCIFORM GUIDANCE SYSTEM

FIELD OF THE INVENTION

This invention relates to a missile comprising a missile body and a cruciform guidance system of four fins provided on the missile body and extending outwardly thereof, the guidance system comprising a first pair of fins disposed in a first common plane, and second pair of fins disposed in a second common plane, said first and second common planes being disposed substantially at right angles to each other.

Hereinafter, for convenience only, such a cruciform guidance system will be referred to as a guidance system comprising "north-south" fins and "east-west" fins.

The guidance system will control the trajectory of the missile in flight, with the north-south fins controlling the lateral movements of the missile by controlling the "yaw" angle, whereas the east-west fins control the amplitude of the missile. In order to achieve accurate control over the desired trajectory for the missile, it is essential that the fins of each pair (north-south or east-west) shall be adjusted simultaneously and in an identical manner, though the adjustment of the pairs of fins as a whole should be independent of each other.

However, this requirement to adjust simultaneously and in an identical manner the two fins of the same pair raises a problem in providing a control device for adjustment of the fins. This occurs due to the fact that the fins are usually located towards the rear portion of the body of the missile, namely at a portion of the missile which houses one or more jet pipes on the interior, so that it is practically impossible to accommodate a transmission unit for simultaneous control of the fins of each pair of fins.

DESCRIPTION OF PRIOR ART

In attempting to solve this problem, it has been proposed pivotally to mount each fin about its own pivotting axis, and to provide an individual adjustment device for each fin. However, in order to achieve the necessary simultaneous adjustment of the fins in each pair, special synchronising means are required which must also ensure that identical adjustment angles are imparted to both fins of each pair of fins.

However, a number of serious drawbacks have resulted with such a proposal in view of factors such as complexity, the volume of the space occupied, and the high cost of the special synchronising means. Moreover, and more seriously, despite the introduction of the special synchronising means, there still remains frequently slight differences in adjustment between two fins of the same pair of fins and this adversely effects the trajectory of the missile by causing a rolling movement about the longitudinal axis thereof.

Furthermore, the difficulties with this proposal are still further increased when it is desired, as is often the case, to provide a missile which can be launched from a tube. In such event, the fins of the cruciform guidance system must be capable of being displaced between a folded position which permits the missile to be inserted in, and launched from, a launching tube, and an open position at which guidance of the missile can be carried out following launching of the missile from the tube.

SUMMARY OF THE INVENTION

It is an object of the invention to provide a missile having a cruciform guidance system in which accurate control of the adjustment of the fins can be achieved in a simple manner.

According to the invention there is provided a missile comprising a missile body, and a cruciform guidance system provided on said missile body, said guidance system comprising;

- a first pair of fins disposed in a first common plane and extending diammetrically outwardly of the missile body;
- a second pair of fins disposed in a second common plane and extending diammetrically outwardly of the missile body;
- a first support carrying said first pair of fins and being adjustably mounted externally of the missile body for pivotal movement relative to the missile body about a first axis contained in said first plane;
- a second support carrying said second pair of fins and being adjustably mounted externally of the missile body for pivotal movement relative to the missile body about a second axis contained in said second plane, said first and second axes being mutually perpendicular when viewed from one end of the missile body;
- first control means coupled with said first support and operable to effect pivotal adjustment of said first support about said first axis so as to vary the angle of said first plane relative to the longitudinal axis of the missile body; and
- second control means coupled with said second support and operable to effect pivotal adjustment of said second support about said second axis so as to vary the angle of said second plane relative to the longitudinal axis of the missile body.

Thus, with a missile according to the invention, it is possible to obtain identical adjustment angles of the two fins of the same pair since the two fins are carried by the same support and can therefore follow accurately the pivotting movements thereof and therefore remain co-planar. Moreover, the inside zone of the missile can remain free at the axial region of the missile where the cruciform guidance system is located (generally at the rear of the missile). Also, by providing a single control means coupled with each support, only two control means are provided to ensure the adjustment of the fins and this contrasts favourably with a prior proposal in which four control means were required in order to control individually the four fins, there also being necessarily synchronising means to control the four control means in the prior proposal.

It is within the scope of the present invention for the fins of the missile to be foldable or not as desired. In the latter case, the fins of each pair can be fixed rigidly and in a co-planar manner to the respective support which ensures maintenance of their initial co-planar relation in all adjusted positions of the support.

Alternatively, when it is desired that the missile be provided with foldable fins to permit launching of the missile from a launch tube, this may be easily achieved by pivotally connecting each fin to its respective support for movement about a pivotal axis extending generally perpendicular to the longitudinal axis of the missile body whereby the fin can be folded forwardly into the folded position.

The present invention is applicable to numerous types of missiles including:

1. Missiles comprising anti-roll fins operated and controlled by a gyroscopic device to prevent the missile turning about its axis, the cruciform guidance system of such a missile being composed of a pair of elevators and a pair of rudders;

2. Missiles which comprise lift planes and which do not turn about their axis, the cruciform guidance system of such a missile also being composed of a pair of elevators and a pair of rudders;

3. Missiles turning about their axis, in which the controls for the two pairs of fins of the cruciform guidance system are excited by a gyroscopic distributor device which select the pair of fins to be operated for obtaining a variation of trajectory in elevation and/or in direction.

It is preferred that the first and second supports, each carrying a pair of fins, be arranged close to each other, but with an axial clearance therebetween to facilitate their respective pivotting movements.

While still providing said axial clearance, it is possible to provide such a shaping for the facing edges of the supports that they can overlap each other in the axial direction whereby their respective pivotal axes can be located in a common transverse plane. With such an arrangement, the action of the guidance system on the missile will be identical for both pairs of fins (assuming identical fins), which would not be the case if the pairs of fins were arranged one behind the other.

In the majority of cases, and notably where missiles turning about their axes are concerned, the components associated with each pair of fins (geometry of the fins and their supports, the radial clearances of the supports and the respective control means for the supports) may be identical.

BRIEF DESCRIPTION OF THE DRAWINGS

The invention will now be described in more detail, by way of example only, with reference to the accompanying drawings in which:

FIG. 1 is a schematic view of a missile provided with a guidance system according to the invention;

FIG. 2 is a perspective view of a rear portion of the missile showing the guidance system in more detail;

FIG. 3 is a perspective view of an end portion of the missile showing a modified mounting arrangement for the guidance system;

FIG. 4 is an end view of the rear of the missile showing a further modified arrangement for mounting and operating the guidance system;

FIG. 5 is a side view corresponding to FIG. 4; and

FIG. 6 is a detail sectional view taken on the line VI—VI in FIG. 4.

DESCRIPTION OF PREFERRED EMBODIMENTS

Referring first of all to FIG. 1 of the drawings, there is shown a missile 100 provided with a guidance system 110 illustrated only schematically. The guidance system 110 is a cruciform guidance system comprising a first pair of guide fins 11 located in a first common plane, and a second pair of guide fins 12 located in a second common plane. As will be described in more detail below, in their mean positions, the first and second planes are mutually perpendicular. For convenience, hereinafter, the first pair of fins 11 and the second pair of fins 12 will be referred to as "north-south" and "east-west" fins respectively.

Referring now to FIG. 2 of the drawings, the guidance system 110 is shown in more detail provided on the rear end of the body 13 of the missile. In this embodiment, the fins 11 and 12 are non-foldable and are rigidly secured to respective supports. Thus, the two fins 11 of the north-south pair are rigidly secured to a rigid, annular support **15*a* which is adjustably mounted externally of the missile body 13 for pivotal movement relative to the missile body about an axis contained in the plane of the fins 11. The pivotal axis of the support 15*a* is provided by a pair of diammetrically opposed trunnions 16 mounted in the rear end of the missile body 13 and slightly upstream of a jet pipe 14 (or a number of jet pipes) located at the rear portion of the body 13**.

Similarly, the fins 12 of the east-west pair are rigidly secured to a rigid annular support **15*b* adjustably mounted externally of the missile body 13 for pivotal movement about an axis contained in the plane of the fins 12. The pivotal axis is defined by a pair of diametrically opposed trunnions 17 mounted in the missile body 13 a small distance upstream of the trunnions 16**.

By virtue of the rigid securement of the fins 11 and 12 to their respective supports **15*a* and 15*b*, it will be evident that pivotal adjustment movement of each support will be accompanied by corresponding adjustment of the plane of the respective fins relative to the longitudinal axis of the missile. Adjustment of the support 15*a* about the axis defined by trunnions 16 will give rise to alteration in the lateral direction of the missile by controlling the "yaw" angle thereof, whereas adjustment of support 15*b* about the axis defined by trunnions 17 will give rise to alteration in attitude control provided by the fins 12**.

The trunnions 16 define a pivotal axis X—X for support **15*a* as shown in FIG. 2, whereas trunnions 17** define a pivotal axis Y—Y and it will be noted that, as seen in end view, the axes XX and YY are mutually perpendicular, though the planes containing the north-south fins and the east-west fins will only be strictly mutually perpendicular when the fins are in their mean positions.

First and second independently operable control means are provided to control the angular settings of the annular support **15*a* and 15*b*** about their respective pivotting axes XX and YY.

Conveniently, but not necessary, each control means may comprise a pair of simultaneously operable control devices which are disposed at diametrically opposed locations with respect to the missile body 13. In this way, equilibrium of the annular supports **15*a* or 15*b*** in relation to its respective pivotting axis can be achieved, which enables the control of the annular supports to be unaffected by inertia forces created during acceleration of the missile.

Thus, as shown in FIG. 2, a pair of control devices are provided for controlling the pivotal setting of the support **15*a* and take the form of a pair of diametrically opposed jacks 18*a*. The jacks 18*a* constitute extensible and retractible actuators which have a line of action located in a plane perpendicular to the plane of the north-south fins. Similarly, a pair of jacks 18*b* are coupled with the support 15*b*** and have lines of action located in a plane perpendicular to the plane of the east-west fins.

The two pairs of jacks **18*a* and 18*b* are connected fast with the body 13 of the missile and each of these two pairs of jacks is linked by a respective transmission system 19***a* or 19*b* to a control box 20. The jacks 18*a* and 18*b* may be comprised by any suitable form of extensible and retractible actuators, e.g., pneumatic or hydraulic rams, electrical or mechanical jacks, and the nature of the transmission systems 19*a* and 19*b* will be chosen in accordance with the type of jack employed.

The control box 20 is illustrated only schematically and may form part of any suitable guidance and control system for the missile. Thus, the control box 20 may be capable of receiving and transmitting, for one or the other of the two pairs of fins 11 and 12, orders for adjustment of the trajectory of the missile generated by a control centre and fed to the control box 20 by a communication channel 21. The signals transmitted to the control box 20 may be derived from any conventional type of missile control system employing, e.g., a programmer, an inertia station, a tele-control post by Hz waves or an auto-searcher device.

By means of the control box 20, the north-south and east-west fins can be adjusted, positively or negatively, from a mean position in progressive manner by suitable adjustment of the supports 15*a* and 15*b* by means of the respective control means operated by the control box 20.

Referring now to FIG. 3 of the drawings, there is shown a modified arrangement of mounting for the fins 11 and 12, though parts corresponding with the previous embodiment are designated by the same reference numerals and need not be described in detail again. In this arrangement, the construction and arrangement of the annular supports 15*a* and 15*b* is modified somewhat by a particular shaping of the facing edges thereof. It will be seen from FIG. 3 that the supports 15*a* and 15*b* overlap to a certain extent axially, i.e., parallel to the longitudinal axis of the missile, though it should be noted that axial clearance remains between the facing edges by virtue of the clearance *j* provided therebetween. By this arrangement, it is possible for the pivotal axes of the fins (axes XX and YY provided by trunnions 16, 17) to be located in a common plane perpendicular to the longitudinal axis of the missile. Thus, the north-south and east-west fins are located in the same axial region of the missile, rather than being axially spaced as shown in FIG. 2.

Although the supports 15*a* and 15*b* overlap to a certain extent in the axial direction, it is essential that the clearance *j* be provided in order to permit the pivotal adjustment movement of the supports 15*a* and 15*b* about their respective pivotal axes. This clearance is equivalent to the radial clearances which are provided between the annular supports 15*a* and 15*b* and the periphery of the missile body 13 in FIG. 2, such radial clearances determining the range of the pivotal movements which are possible for the supports 15*a* and 15*b*.

Further by the arrangement according to FIG. 3, it is possible for the fins and the respective annular supports to be identical and hence the action of each pair of fins on the trajectory of the missile can be of equal effects for a given adjustment angle, which is indispensible for guiding a missile turning about its axis.

When it is desired to provide a missile which can be launched from a tube, it is desirable to provide a guidance system in which the fins can be folded, i.e., they can be moved between a folded position in which the missile can be inserted into a launch tube, and an "open" position serving for guidance of the missile following launching of the missile from the tube. To this end, the fins 11 and 12 may be pivotally connected to their respective supports by means of pivots 22. Thus, the fins can be folded forwardly about the pivots 22 to the folded position, the pivots 22 defining pivotting axes extending perpendicular to the longitudinal axis of the missile.

Conveniently, as shown in more detail in FIG. 5, biasing means can be provided to bias the fins 11 (and 12 although not shown) from the folded positions towards the open position. The biasing means shown in FIG. 5 comprises a torsion spring 24 wound around each pivot 22 and suitably anchored. Following launching of the missile from a launch tube, the fins 11 and 12 will tend to pivot about their pivots 22 in a rearward direction both due to inertia and also aero-dynamic drag in the air flow, but this action will be promoted by the biasing springs 24.

In order to limit the rearward pivotal movement of the fins 11 and 12, stops 23 are provided at suitable locations which thereby define the "open" or unfolded positions of the fins.

Referring now in more detail to FIGS. 4 to 6 of the drawings, there is shown a modified arrangement of control means for effecting the pivotal adjustment of the supports 15*a* and 15*b*. The arrangement shown in FIGS. 4 to 6 is particularly suitable for a construction of missile in which guiding of the missile operates "by all or nothing," namely by supplying for each pair of fins three possible positions, that is, one neutral position in zero incidence, one position of positive predetermined incidence, and one position of pre-determined negative incidence, of the same absolute value.

It should be noted that, for this method of guiding "by all or nothing," the absolute value of the pre-determined adjustment angles of the fins may have a very low value, for example of the order of 1°, the size of the change of course imposed on the missile being then an increasing function of the duration of the adjustment of the pairs of fins brought into action.

Parts corresponding with the preceding embodiments are designated by the same reference numerals and need not be described in detail again.

The annular support 15*a* carrying the north-south fins 11 is subject to the action of biasing means tending to move it towards its neutral or mean position, the biasing means comprising restoring media made up for example of two identical transverse leaf springs 25*a*. The springs 25*a* are diametrically opposed and secured at one of their ends to the support 15*a* and are supported at their other ends against respective stops 26*a* coupled fast with the missile body 13.

Two electro-magnets 27*a* are provided which constitute extensible and retractible actuators and which are diametrically opposed as seen in FIG. 4. Operation of one of the electro-magnets 27*a* causes the support 15*a* to pivot in one direction about trunnions 16 against the action of the restoring spring 25*a* at an angle of predetermined absolute value, whereas excitation of the other electro-magnets 27*a* causes the support 15*a* to pivot in the other direction and always contrary to the action of the restoring springs 25*a* at an angle having the same above mentioned predetermined absolute value.

In similar manner, the annular support 15*b* carrying the east-west fins 12 is provided with control means in the form of two restoring leaf springs 25*b* (shown in dashes in FIG. 4) and two electro-magnets 27*b*. The restoring springs 25*b* and the electro-magnets 27*b* are identical (and have similar roles) to the springs 25*a* and the electro-magnets 27*a* but are offset at an angle of 90°.

As shown particularly in FIG. 5, a particularly favorable arrangement is obtained for the electro-magnets as now described for an electro-magnet 27*a*. The moveable armature of the electro-magnet 27*a* is connected by a plate P to the respective annular support 15*a* by an arm B which is pivotally connected to the support 15*a* by a swivel joint R, thereby enabling the armature to come flush up against the electro-magnet casing, despite the slope which the annular support presents when it is adjusted by the electro-magnet.

With the all or nothing control, the north-south fins 11 will be maintained in their zero incidence or mean position by the springs 25*a*, when the two electro-magnets 27*a* are not energized, whereas the fins will be completely adjusted in one direction when one of the electro-magnets 27*a* is energized and completely adjusted in the other direction when the other electro-magnet 27*a* is energized. Similarly, the east-west fins 12 are held in their zero incidence or mean position by the springs 25*b* when the electro-magnets 27*b* are unenergized, and completely adjusted in one or the other direction depending on which of the electro-magnets 27*b* is energized.

It is to be understood that embodiments of missile and guidance systems therefor described above, and with reference to the drawings, are purely illustrative of the present invention and that many other variants are to be included within the scope of the invention as defined in the following claims.

We claim:

1. A missile comprising a missile body, and a cruciform guidance system provided on said missile body, said guidance system comprising;

a first pair of fins disposed in a first common plane and extending diammetrically outwardly of the missile body;

a second pair of fins disposed in a second common plane and extending diammetrically outwardly of the missile body;

a first support carrying said first pair of fins and being adjustably mounted externally of the missile body for pivotal movement relative to the missile body about a first axis contained in said first plane;

a second support carrying said second pair of fins and being adjustably mounted externally of the missile body for pivotal movement relative to the missile body about a second axis contained in said second plane, said first and second axes being mutually perpendicular when viewed from one end of the missile body;

first control means coupled with said first support and operable to effect pivotal adjustment of said first support about said first axis so as to vary the angle of said first plane relative to the longitudinal axis of the missile body; and second control means coupled with said second support and operable to effect pivotal adjustment of said second support about said second axis so as to vary the angle of said second plane relative to the longitudinal axis of the missile body, said first and second supports comprising rigid annular supports each of which surrounds the missile body with a predetermined radial clearance, each said clearance determining the range of pivotal adjustment for the corresponding annular support.

2. A missile according to claim 1, including trunnions connected to each annular support at diammetrically opposed regions and connected to the missile body to provide the pivotal mounting for each support.

3. A missile according to claim 2, in which each pair of fins is rigidly secured to its respective support.

4. A missile according to claim 1, in which the fins of each pair are pivotally connected to their respective support for movement between a folded position suitable to permit the missile to be inserted in, and launched from, a launching tube, and an open position suitable for exercising guidance to the missile following launching from said tube.

5. A missile according to claim 4, including biasing means arranged to bias the fins from said folded position and at least partly towards said open position.

6. A missile according to claim 1, in which the annular supports are located close to each other at the rear of the missile body, the supports being spaced axially from each other by a distance sufficient to permit the respective pivotal movements of the supports.

7. A missile according to claim 6, in which the annular supports have facing edges so arranged and spaced apart that said first and second pivotal axes are located in a common plane perpendicular to the longitudinal axis of said missile body, while permitting said pivotal movements of the supports.

8. A missile according to claim 1, in which each of said first and second control means comprises a pair of control devices arranged externally of the missile body at diammetrically opposed locations.

9. A missile according to claim 8, in which each control means comprises a pair of extensible and retractible actuators.

10. A missile according to claim 8, including biasing means associated with each pair of control devices and arranged to urge, and to maintain, the respective support in a mean position.

11. A missile according to claim 10, in which each control devices comprises an electromagnet having a moveable armature pivotally connected to the respective support.

12. A missile according to claim 1, including a guidance monitoring device coupled with said first and second control means to control the trajectory of the missile.

13. A missile according to claim 1 wherein said first pair of fins are integral with said first support and said second pair of fins are integral with said second support, said first and second supports each being mounted for rotation with respect to the body of the missile.

* * * * *